United States Patent [19]

Vadnais

[11] Patent Number: 4,482,116

[45] Date of Patent: Nov. 13, 1984

[54] ADJUSTABLE PLASTIC FILM BAG MOUTH SUPPORT

[75] Inventor: Kenneth Vadnais, Livonia, Mich.

[73] Assignee: New Product, Inc., Southfield, Mich.

[21] Appl. No.: 363,016

[22] Filed: Mar. 29, 1982

[51] Int. Cl.[3] ..... B65B 67/04

[52] U.S. Cl. ..... 248/99; 53/390; 294/1 R; 141/390; 15/257.1

[58] Field of Search ..... 248/99, 100, 101, 95; 135/905, 104, 102, 101; 141/390, 68, 10, 114, 313-317; 15/257.1; 294/1 R, 1 B, 1 BA, 55; 53/390

[56] References Cited

U.S. PATENT DOCUMENTS

| | | | |
|---|---|---|---|
| 678,684 | 7/1901 | Powell | 248/99 |
| 1,097,701 | 5/1914 | Yont | 248/99 |
| 2,654,892 | 10/1953 | Szabo | 141/390 |
| 2,684,128 | 7/1954 | Brace | 248/99 |
| 3,675,667 | 7/1972 | Miller | 135/905 |
| 3,866,872 | 2/1975 | Burgess | 248/101 |
| 3,893,649 | 7/1975 | Cornell | 248/101 |
| 3,960,161 | 6/1976 | Norman | 135/905 |

*Primary Examiner*—Reinaldo P. Machado
*Assistant Examiner*—Alvin Chin-Shue
*Attorney, Agent, or Firm*—Reising, Ethington, Barnard Perry & Milton

[57] ABSTRACT

The invention comprises an adjustable support to retain the mouths of commonly available plastic film garbage and leaf bags fully open. The bag mouth support folds and unfolds into a compact shape for packaging and for storage. Fully open the support is of substantially square or rectangular shape with one of the sides telescopingly adjustable to increase or decrease the perimeter length of the support.

3 Claims, 6 Drawing Figures

ADJUSTABLE PLASTIC FILM BAG MOUTH SUPPORT

BACKGROUND OF THE INVENTION

The field of the invention pertains to the commonly available plastic film garbage and leaf bags and, in particular, to means for retaining the mouth of the bag fully open so that the bag may be filled expeditiously.

The mouths of plastic film garbage bags are most commonly held open by wrapping the edge of the bag over the edge of a garbage can into which the bag has been inserted. Upstanding wheeled frameworks have been used to support leaf bags with the bag mouth wrapped about the framework. Both means of holding a bag mouth open, however, are very cumbersome and awkward in many applications. In particular, when sweeping debris or raking leaves, it is desirable to have the bag horizontally resting on the ground with the bag mouth fully open so that the loose refuse may be quickly deposited thereinto. With a view toward providing means to retain the bag mouth fully open in a very convenient and economical manner, applicant has developed the support described below.

SUMMARY OF THE INVENTION

The invention comprises an adjustable support to retain the mouths of commonly available plastic film garbage and leaf bags fully open. The bag mouth support folds and unfolds into a compact shape for packaging and for storage. Fully open the support is of substantially square or rectangular shape with one of the sides telescopingly adjustable to increase or decrease the perimeter length of the support.

In the preferred embodiment the support is very economically formed by folding a length of nominal one-half inch plastic water pipe and inserting a wooden dowel to join the ends of the plastic pipe. The mouth of the plastic film garbage or leaf bag is wrapped over the support which then retains the bag mouth open as the bag is filled.

DESCRIPTION OF THE PREFERRED EMBODIMENT

Figure 1:
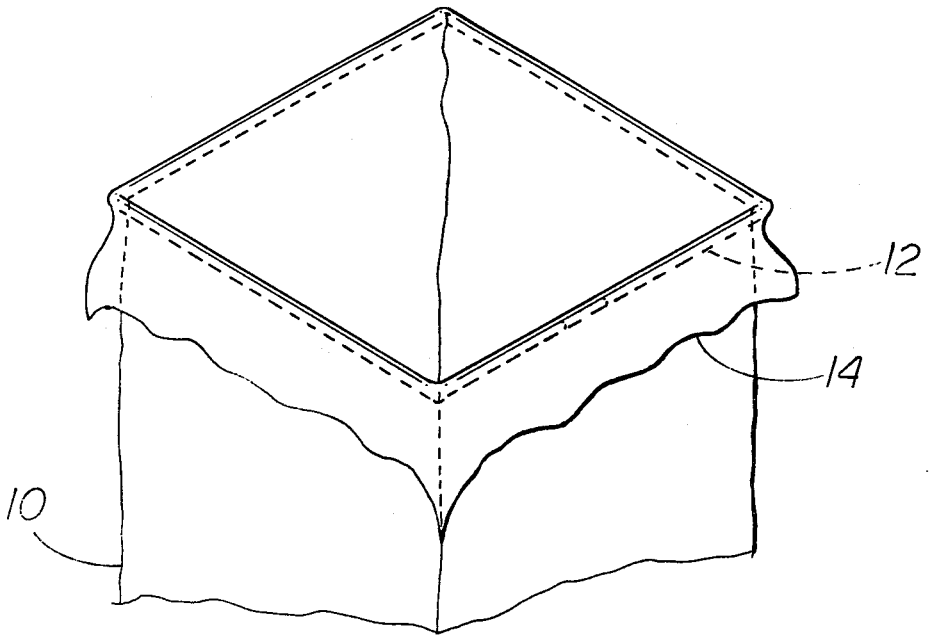
FIG. 1 is a perspective view of the open top of a plastic film bag incorporating the support.

Illustrated in FIG. 1 is the open top of a typical plastic film garbage or leaf bag 10. The top is held open in a substantially square or rectangular shape by the bag mouth support 12 with the top edge 14 of the plastic film folded thereover as shown.

Figure 2:
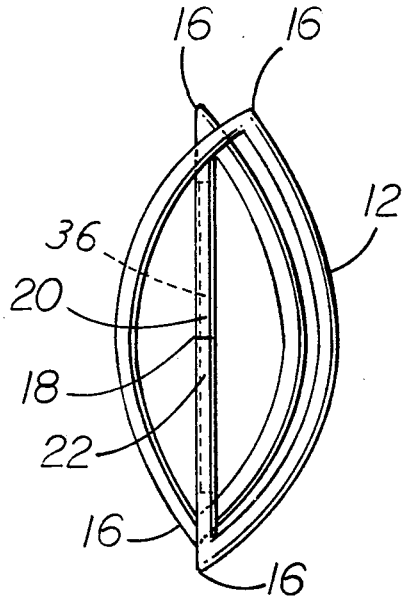
FIG. 2 is a view of the support completely folded.

FIG. 2 illustrates the bag mouth support 12 fully folded for compactness and insertion into packaging. The support 12 comprises a plastic tube folded at four substantially equidistant locations 16 with both ends of the tube meeting at 18. The ends of the tube 20 and 22 are not permanently fastened together but rather retained by a wooden dowel for adjustment and rotation as described below. With the exception of the dowelled ends 20 and 22, the sides of the support are bowed in the folded configuration shown in FIG. 2.

Figure 3:
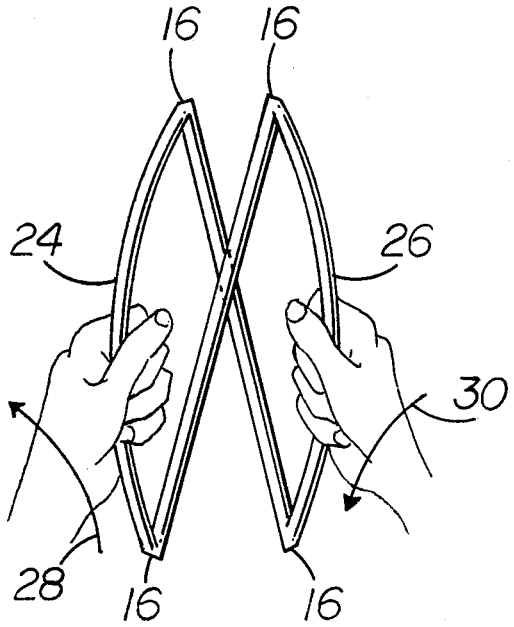
FIG. 3 is a view of the initial unfolding of the support.
Figure 4:
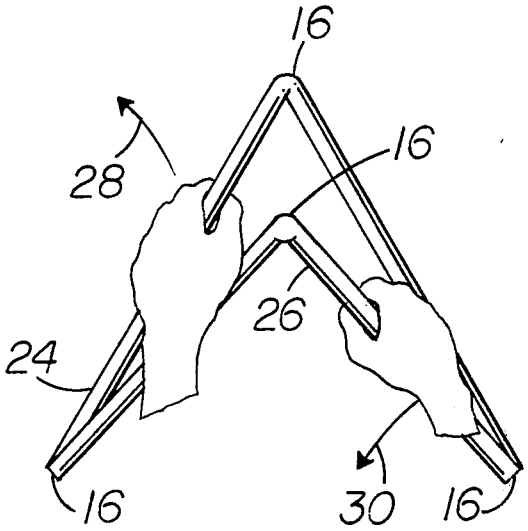
FIG. 4 is a view of the final unfolding of the support.
Figure 5:
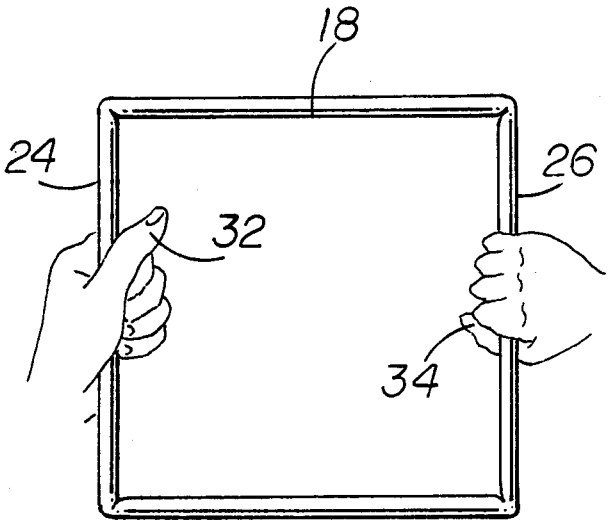
FIG. 5 is a view of the support completely unfolded.

FIGS. 3, 4 and 5 illustrate the unfolding and folding of the support 12. Grasping of two of the opposite sides 24 and 26 as shown and rotating oppositely as shown by arrows 28 and 30 unfolds the support 12 into substantially a square or rectangle. The bag mouth 14 can then be wrapped about the support 12 as shown in FIG. 1.

The support 12 can be refolded for storage by grasping with the left thumb 32 up and right thumb 34 down on opposite sides 24 and 26 as shown in FIG. 5. The hands are then twisted opposite to the arrows 28 and 30 in FIGS. 4 and 3. The support 12 can then be more compactly stored for re-use.

As noted above the ends 20 and 22 of the tube are not permanently fastened together but rather allowed to rotate relative to each other as the support 12 is folded and unfolded. Between the fully folded configuration of FIG. 2 and the fully unfolded configuration of FIG. 5 the ends 20 and 22 rotate 360° relative to each other. This rotational relationship permits the fully open configuration of the support 12 shown in FIG. 5 and the fully folded configuration shown in FIG. 2 to both be stable shapes for the support. The support 12 remains folded indefinitely in the configuration of FIG. 2 without the need for a cover or band to retain the support folded.

Figure 6:
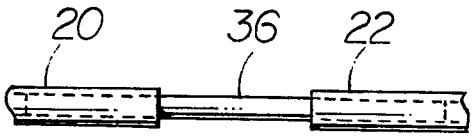
FIG. 6 is a partial view of the support illustrating the adjustment for bag size.

Since plastic film garbage and leaf bags are available in several different capacities with different size mouth openings, support 12 is adjustable as illustrated in FIG. 6. As noted above the ends 20 and 22 of the support 12 are joined by a wooden dowel 36 inserted therein as shown. The dowel 36 and tubing of the support 12 are sized to provide a rotatable but tight sliding fit such that the distance between the ends 20 and 22 will be retained when the bag 10 is wrapped on the support 12 and used. As the ends 20 and 22 are moved apart on the dowel 36, the substantially square shape of the open support as shown in FIG. 5 is distorted and the end portions 20 and 22 of the tube tend to bow. This tendency to bow causes the tube ends 20 and 22 to more tightly grip the dowel 36 thus retaining any adjustment of the tube ends 20 and 22 on the dowel. Thus, by adjusting the gap between the support ends 20 and 22, the perimeter of the support can be adjusted to fit various differing plastic film bag mouths. After wrapping the bag mouth top edge 14 over the support 12 as shown in FIG. 1, the support is tugged open slightly more to tighten the bag 10 thereon. The tight grip of the tube ends 20 and 22 on the dowel 36 retains the bag tightly on the support.

Although a variety of plastic materials and dowel materials could be selected for the support 12, a particularly economical construction is as follows. The support is formed from a five foot length of nominal one-half inch outside diameter, three-eighths inch inside diameter polyvinylchloride or polyethylene water pipe folded to provide approximately fifteen inch sides. The wooden dowel is a nominal three-eighths inches in diameter and twelve inches long. The total perimeter length can be extended from five feet to five feet eight inches. This range has been found suitable for the larger garbage bags and leaf bags available in southeastern Michigan, however, other suitable sizes of support can be constructed without departing from the spirit of applicant's invention.

I claim:

1. A support for retaining the mouth of a plastic film bag open comprising, a tube having two ends and being partially folded at a plurality of spaced locations, and means joining said ends of said tube together between two of said spaced locations forming a closed parallelogram having one inflexible length including said joining means and three other flexible lengths, said support as partially folded being sized to retain a film bag mouth wrapped thereabout substantially open through said support, and said support being foldable by manually rotating opposed portions of said tube in opposite directions, said flexible lengths tending to bow to more tightly retain said joining means within said ends of said tube.

2. The support of claim 1 wherein said joining means includes a dowel inserted into said ends of said tube to join said ends together, said tube ends being adjustable on said dowel to lengthen or shorten the periphery of said support.

3. The support of claim 1 including rotatable means joining the ends of the tube together.

* * * * *